US007993101B2

(12) United States Patent
Hasselqvist

(10) Patent No.: US 7,993,101 B2
(45) Date of Patent: Aug. 9, 2011

(54) NICKEL BASE ALLOY AND USE OF IT, TURBINE BLADE OR VANE AND GAS TURBINE

(75) Inventor: Magnus Hasselqvist, Finspong (SE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/921,879

(22) PCT Filed: Feb. 27, 2009

(86) PCT No.: PCT/EP2009/052343

§ 371 (c)(1), (2), (4) Date: Nov. 23, 2010

(87) PCT Pub. No.: WO2009/112380

PCT Pub. Date: Sep. 17, 2009

(65) Prior Publication Data

US 2011/0058954 A1 Mar. 10, 2011

(30) Foreign Application Priority Data

Mar. 14, 2008 (EP) ..... 08004818

(51) Int. Cl.
*F01D 5/14* (2006.01)

(52) U.S. Cl. ..... 415/200; 415/199.5; 416/241 R

(58) Field of Classification Search ..... 415/199.5, 415/200; 416/241 R; 148/427, 428
See application file for complete search history.

(56) References Cited

U.S. PATENT DOCUMENTS

| | | | | |
|---|---|---|---|---|
| 4,459,160 | A * | 7/1984 | Meetham et al. | 148/562 |
| 5,328,659 | A | 7/1994 | Tillman et al. | |
| 6,905,559 | B2 * | 6/2005 | O'Hara et al. | 148/410 |
| 6,969,238 | B2 * | 11/2005 | Groh et al. | 416/213 R |
| 7,278,828 | B2 * | 10/2007 | Steplewski et al. | 416/97 R |
| 2003/0047252 | A1 | 3/2003 | Caron et al. | |

FOREIGN PATENT DOCUMENTS

| | | | |
|---|---|---|---|
| EP | 0924309 | A2 | 6/1999 |
| EP | 1195 446 | A1 | 4/2002 |
| EP | 1204776 | B1 | 5/2002 |
| EP | 1319729 | A1 | 6/2003 |
| WO | WO 9967435 | A1 | 12/1999 |
| WO | WO 0044949 | A1 | 8/2000 |
| WO | WO 0109403 | A1 | 2/2001 |

* cited by examiner

*Primary Examiner* — Ninh H Nguyen

(57) ABSTRACT

A nickel base alloy is provided which includes the following components by weight: Co: 2.75 to 3.25% Cr: 11.5 to 12.5% Mo: 2.75 to 3.25% Al: 3.75 to 4.25% Ti: 4.1 to 4.9% Ta: 1.75 to 2.25% C: 0.006 to 0.04% B: ≦0.01% Zr: ≦0.01% Hf: ≦1.25% Nb: ≦1.25% balance Ni.

9 Claims, 1 Drawing Sheet

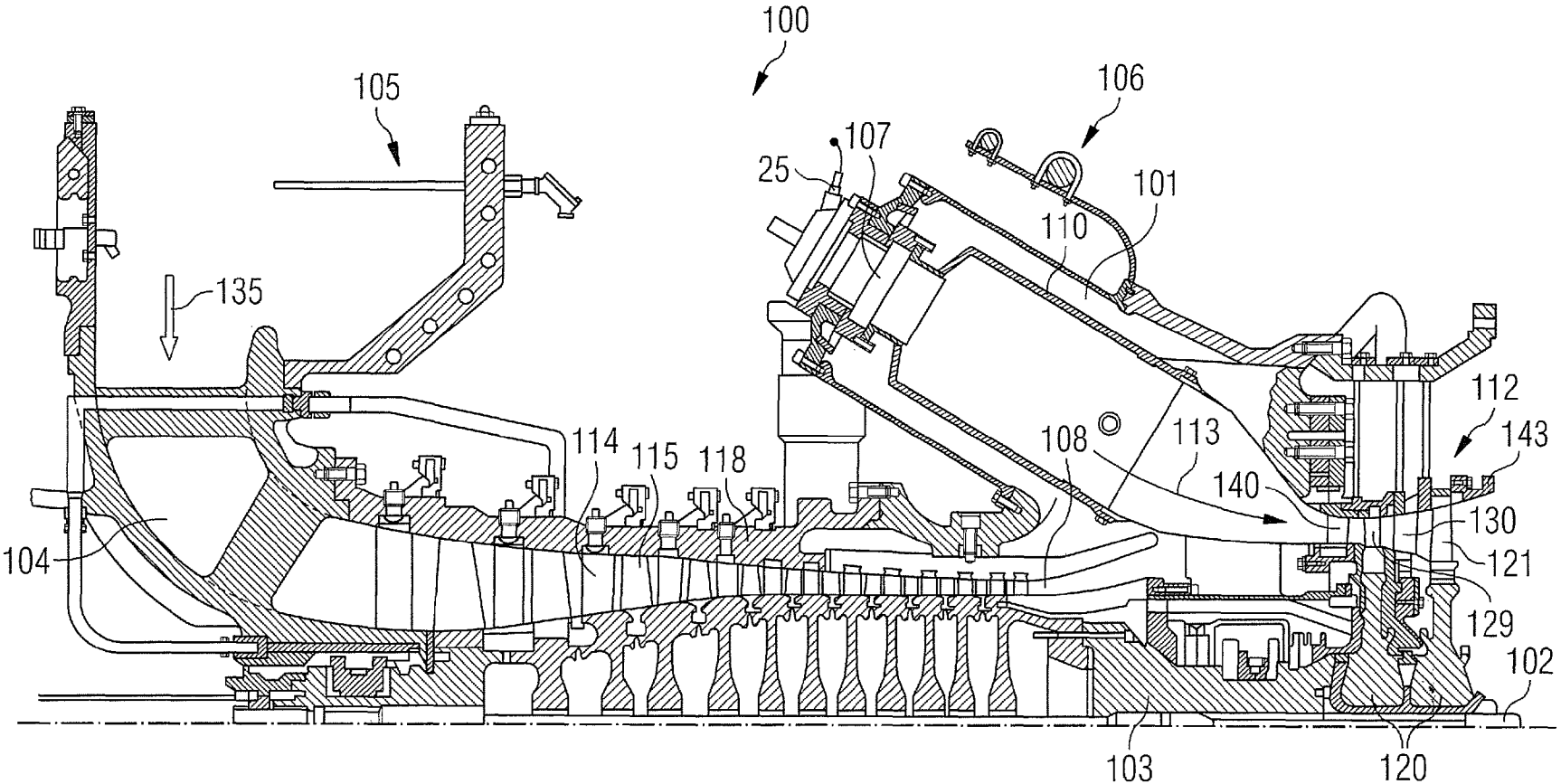
100
101
102
103
104
105
106
107
108
110
112
113
114
115
118
120
121
129
130
135
140
143
25

NICKEL BASE ALLOY AND USE OF IT, TURBINE BLADE OR VANE AND GAS TURBINE

CROSS REFERENCE TO RELATED APPLICATIONS

This application is the U.S. National Stage of International Application No. PCT/EP2009/052343, filed Feb. 27, 2009 and claims the benefit thereof. The International Application claims the benefits of European Patent Office application No. 08004818.4 EP filed Mar. 14, 2008. All of the applications are incorporated by reference herein in their entirety.

FIELD OF INVENTION

The present invention relates to a nickel base alloy, the use of it. In addition, the present invention relates to turbine blades and vanes and to gas turbines.

BACKGROUND OF INVENTION

In operation of a gas turbine, turbine blades and vanes are exposed to hot temperatures and, in case of the blades, to high loads due to the rotation of the turbine rotor to which the blades are fixed. In order to cope with such extreme conditions turbine vanes and blades are usually made from so-called superalloys with high temperature resistance and high creep strength. Known superalloys which are used in turbine blade and vane manufacturing are, for example, disclosed in EP 1 204 776 B1, EP 1 319 729 A1, WO 99/67435 A1 or WO 00/44949 A1. The alloys mentioned in these documents are based on nickel (Ni) or cobalt (Co) and show considerable heat resistance and creep strength. When high creep resistance has been needed in the state of the art alloys with low chromium content i.e. up to about 10% by weight chromium content, like the alloys known under CM247DS (with a high density) and IN100 (with a low density), have been used frequently. With less emphasis on creep resistance, alloys with high chromium content, i.e. above at least about 11% chromium content, like the alloys known under IN792 (with moderate density) or Rene77 (with low density) have been utilised. Recently, a promising high creep resistance alloy being called SCB444 and having high chromium content was developed. This alloy, which is described in U.S. 2003/0047252 A1, has the following composition by weight:

Co (cobalt): 4.75 to 5.25%
Cr (chromium): 11.5 to 12.5%
Mo (molybdenum): 0.8 to 1.2%
W (tungsten): 3.75 to 4.25%
Al (aluminium): 3.75 to 4.25%
Ti (titanium): 4 to 4.8%
Ta (tantalum): 1.75 to 2.25%
C (carbon): 0.006 to 0.04%
B (boron): ≦0.01%
Zr (zirconium): ≦0.01%
Hf (hafnium): ≦1%
Nb (niobium): ≦1%
nickel (Ni) and any impurities: complement to 100%.

SUMMARY OF INVENTION

It is an objective of the present invention to provide a further composition for a nickel base alloy with high creep resistance and a use for such an alloy.

It is a further objective of the present invention to provide improved turbine blades or vanes as well as to provide a gas turbine with improved blades.

The first objective is solved by a nickel base alloy as claimed in the claims.

The further objective is solved by a turbine blade or vane as claimed in the claims and by a gas turbine as claimed in the claims or a gas turbine as claimed in the claims. The depending claims define further developments of the invention.

According to a first aspect of the invention, a nickel base alloy is provided which comprises the following components by weight:

Co: 2.75 to 3.25%
Cr: 11.5 to 12.5%
Mo: 2.75 to 3.25%
Al: 3.75 to 4.25%
Ti: 4.1 to 4.9%
Ta: 1.75 to 2.25%
C: 0.006 to 0.04%
B: ≦0.01%
Zr: ≦0.01%
Hf: ≦1.25%
Nb: ≦1.25%
balance Ni.

Compared to SCB444 the inventive alloy has a density below 8000 kg/m$^3$ and a larger lattice constant than SCB444. These characteristics are derived by omitting the tungsten (W) of SCB444 and increasing the amount of molybdenum (Mo), titanium (Ti) and the upper limits of niobium (Nb) and hafnium (Hf), all of which are lighter elements than tungsten. Of these elements molybdenum contributes mainly to the matrix of the alloy while the other mentioned elements contribute mainly to the formation of strengthening particles which are embedded in the matrix.

Compared to SCB444 the amount of strengthening elements in the matrix and the particles are kept at similar mole fraction. Ti, Nb and Hf are more potent strengtheners of the particles than W, which adds to the strength of the alloy. Mo is also slightly more potent than W, but the strengthening of the matrix is essentially kept constant.

In a first development the alloy may comprise the following elements by weight:

Co: 2.75 to 3.25%
Cr: 11.5 to 12.5%
Mo: 2.75 to 3.25%
Al: 3.75 to 4.25%
Ti: 4.1 to 4.9%
Ta: 1.75 to 2.25%
C: 0.006 to 0.04%
B: ≦0.01%
Zr: ≦0.01%
Hf: ≦0.01%
Nb: 0.75 to 1.25%
balance nickel.

In an alternative development the alloy could comprise the following components by weight:

Co: 2.75 to 3.25%
Mo: 2.75 to 3.25%
Al: 3.75 to 4.25%
Ti: 4.1 to 4.9%
Ta: 1.75 to 2.25%
C: 0.006 to 0.04%
B: ≦0.01%
Zr: ≦0.01%
Hf: 0.75 to 1.25%
Nb: 0.25 to 0.75%
balance nickel.

The replacement of tungsten compared to SCB444 reduces the solvus temperature which will have an adverse effect on the creep strength at high temperature. However, this effect will be insignificant for the relatively lower temperatures experience by turbine blades and vanes which are located in the later stages of a turbine compared to blades and vanes of earlier stages, i.e. at least the first stage. In the later stages the temperature of a hot combustion gas driving the turbine has already been reduced due to momentum transfer to the turbine and expansion in the earlier stages. Therefore, the heat resistance is less important for the later stages than for the earlier stages. On the other hand, the radius of later stages is usually larger than of the earlier stages, in particular the first stage. This means that the loads acting on the outsides of the blades are higher in the later stages than in the earlier stages, which makes the creep resistance an important issue, in particular if the radius of the later stages shall be further increased in future turbine generations.

The inventive alloy can, therefore, advantageously be used for making turbine blades and/or vanes, in particular for making turbine blades of later turbine stages.

According to the invention, also a turbine blade or vane is provided at least a part of which consists of a base material which is an inventive alloy.

As has been already mentioned, the inventive alloy has a high potential for making turbine blades or vanes of later turbine stages. Therefore, according to the invention, an improved gas turbine with a flow path for hot combustion gases and first and second turbine blades located in the flow path is provided. The second turbine blades are located downstream of the first turbine blades and are made from a base material which is different to the base material of the first turbine blades. The second turbine blades consist at least partly of a base material which is an alloy according to the invention. Note, that there may be more than one stage of first turbine blades and more than one stage of second turbine blades.

Usually the first turbine blades are internally cooled so that they are less creep loaded than the second turbine blades which are usually not cooled. By using different alloys for different stages of a turbine it becomes possible to tailor the alloys to the specific needs of the respective stages. For example, the earlier turbine stages can be equipped with turbine blades and vanes having a high heat resistance but less creep strength. On the other hand, the turbine blades and vanes, in particular the turbine blades, of later stages can be formed from a base alloy having less heat resistance but increased creep strength as compared to the alloy of the earlier stages. Therefore, according to the invention, also a gas turbine with a flow path for hot combustion gases and first and second turbine blades located in the flow path is provided. The second turbine blades are located downstream of the first turbine blades and are made from a base material which is different to the base material of the first turbine blades. The first turbine blades and vanes are made from an alloy with a higher heat resistance and lower creep strength than the alloy the second blades and vanes are made of. The second alloy may, in particular be an inventive alloy as it is mentioned above.

In particular increasing the creep strength of the later stages at the cost of the heat resistance allows for longer turbine blades in the later stages of the gas turbine without increasing the loads on the later stage disks. Longer blades offer the opportunity to reduce the mach-number into the diffusor, the losses in the diffusor and thus to improve power and efficiency.

A relevant measure of the creep strength in the later stages of a gas turbine is the allowable stress for a creep-rupture time of 40000 hours in the 650 to 850° C. temperature range. This can be provided by the inventive alloy.

BRIEF DESCRIPTION OF THE DRAWINGS

Further features, properties and advantages of the present invention will become clear from the following description of embodiments of the invention in conjunction with the accompanying drawing.

FIG. 1 shows a gas turbine in a sectional view.

DETAILED DESCRIPTION OF INVENTION

FIG. 1 shows an example of a gas turbine 100 in a sectional view. The gas turbine 100 comprises a compressor section 105, a combustor section 106 and a turbine section 112 which are arranged adjacent to each other in the direction of a longitudinal axis 102. It further comprises a rotor 103 which is rotatable about the rotational axis 102 and which extends longitudinally through the gas turbine 100.

In operation of the gas turbine 100 air 135, which is taken in through an air inlet 104 of the compressor section 105, is compressed by the compressor section and output to the burner section 106. The burner section 106 comprises a burner plenum 101, one or more combustion chambers 110 and at least one burner 107 fixed to each combustion chamber 110. The combustion chambers 110 and sections of the burners 107 are located inside the burner plenum 101. The compressed air from the compressor exit 108 is discharged into the burner plenum 101 from where it enters the burners 107 where it is mixed with a gaseous or liquid fuel. In the present embodiment a gaseous fuel and a liquid fuel, e.g. oil, can be used alternatively. The air/fuel mixture is then burned and the combustion gas 113 from the combustion is led through the combustion chamber 110 to the turbine section 112.

A number of blade carrying discs 120 are fixed to the rotor 103 in the turbine section 112 of the engine. In the present example, two discs carrying turbine blades 121, 129 are present. In addition, guiding vanes 130, which are fixed to a stator 143 of the gas turbine engine 100, are disposed between the turbine blades 121. However, often more than two discs are present. Between the exit of the combustion chamber 110 and the leading turbine blades 121 inlet guiding vanes 140 are present. Each blade carrying disc 120 forms together with a row of guiding vanes 130, 140 a turbine stage of the turbine.

The combustion gas from the combustion chamber 110 enters the turbine section 112 and, while expanding and cooling when flowing through the turbine section 112, transfers momentum to the turbine blades 121, 129 of the turbine stages which results in a rotation of the rotor 103. The guiding vanes 130, 140 serve to optimise the impact of the combustion gas on the turbine blades 121, 129.

Since the combustion gas is hotter in the first stage than in the second stage, the vanes 140 and blades 129 of the first turbine stage are made from a state of the art alloy with a high heat resistance, for example from SCB444, while the blades 121 and/or vanes 130 of the second stage are made from an alloy according to the invention. Thereby the heat resistance of the blades and vanes of the second stage is lower than the heat resistance of the blades and vanes of the first stage. On the other hand, the creep strength of the blades and vanes of the second stage is higher than the creep strength of the blades and vanes of the first stage. The creep strength of the blades and vanes of first stage (or of the leading stages if a larger number of stages is present) can be less than the creep strength of the later stage (or later stages) since the blades and vanes of the first stage (or leading stages) are often internally cooled while the blades and vanes of the later stage (or stages) are not cooled.

In a first example, the blades 121 and/or vanes 130 of the second stage (or later stages) are made from an inventive nickel base alloy comprising the following components by weight: Co: 3%; Cr: 12%; Mo: 3%; Al: 4%; Ti: 4.5%; Ta: 2%; Nb: 1%; balance Ni.

In a second example, the blades 121 and/or vanes 130 of the second stage (or later stages) are made from an inventive nickel base alloy comprising the following components by weight: Co: 3%; Cr: 12%; Mo: 3%; Al: 4%; Ti: 4.5%; Ta: 2%; Nb: 0.5%; Hf: 1%; balance Ni.

The invention claimed is:

1. A nickel base alloy, comprising (in a weight percentage):
Co: 2.75 to 3.25%;
Cr: 11.5 to 12.5%;
Mo: 2.75 to 3.25%;
Al: 3.75 to 4.25%;
Ti: 4.1 to 4.9%;
Ta: 1.75 to 2.25%;
C: 0.006 to 0.04%;
B: ≦0.01%;
Zr: ≦0.01%;
Hf: ≦1.25%;
Nb: ≦1.25%; and
balance Ni.

2. The nickel base alloy as claimed in claim 1, wherein
Hf: ≦0.01%, and
Nb: 0.75 to 1.25%.

3. The nickel base alloy as claimed in claim 1, wherein
Hf: 0.75 to 1.25%, and
Nb: 0.25 to 0.75%.

4. A turbine blade or vane, comprising:
a nickel base alloy, comprising: (in a weight percentage):
Co: 2.75 to 3.25%,
Cr: 11.5 to 12.5%,
Mo: 2.75 to 3.25%,
Al: 3.75 to 4.25%,
Ti: 4.1 to 4.9%,
Ta: 1.75 to 2.25%,
C: 0.006 to 0.04%,
B: ≦0.01%,
Zr: ≦0.01%,
Hf: ≦1.25%,
Nb: ≦1.25%, and
balance Ni.

5. The turbine blade or vane as claimed in claim 4, wherein
Hf: ≦0.01%, and
Nb: 0.75 to 1.25%.

6. The turbine blade or vane as claimed in claim 4, wherein
Hf: 0.75 to 1.25%, and
Nb: 0.25 to 0.75%.

7. A gas turbine including a flow path for hot combustion gases, comprising:
a plurality of first turbine blades located in the flow path; and
a plurality of second turbine blades located in the flow path, wherein the plurality of second turbine blades are located downstream of the plurality of first turbine blades, and
wherein the plurality of second turbine blades are made from a second base material which is different from a first base material of the first blades, and
wherein the plurality of second turbine blades comprise a nickel base alloy which includes (in a weight percentage):
Co: 2.75 to 3.25%,
Cr: 11.5 to 12.5%,
Mo: 2.75 to 3.25%,
Al: 3.75 to 4.25%,
Ti: 4.1 to 4.9%,
Ta: 1.75 to 2.25%,
C: 0.006 to 0.04%,
B: ≦0.01%,
Zr: ≦0.01%,
Hf: ≦1.25%,
Nb: ≦1.25%, and
balance Ni.

8. The gas turbine as claimed in claim 7, wherein
Hf: ≦0.01%, and
Nb: 0.75 to 1.25%.

9. The gas turbine as claimed in claim 7, wherein
Hf: 0.75 to 1.25%, and
Nb: 0.25 to 0.75%.

* * * * *